United States Patent [19]

Funk

[11] Patent Number: 4,913,869

[45] Date of Patent: Apr. 3, 1990

[54] WET-SPINNING PROCESSES FOR PRODUCING ACRYLIC FILAMENTS

[75] Inventor: Paul M. Funk, Decatur, Ala.

[73] Assignee: Monsanto Company, St. Louis, Mo.

[21] Appl. No.: 289,142

[22] Filed: Dec. 23, 1988

[51] Int. Cl.[4] ..... D01F 6/38

[52] U.S. Cl. ..... 264/182; 264/210.7; 264/210.8; 264/211.15; 264/211.16; 264/233; 264/290.5

[58] Field of Search ..... 264/290.5, 210.7, 210.8, 264/182, 233, 211.15, 211.16

[56] References Cited

U.S. PATENT DOCUMENTS 2,596,128 5/1952 Chavannes et al. ..... 264/290.5

3,947,538 3/1976 Marshall et al. ..... 264/290.5

FOREIGN PATENT DOCUMENTS 42-4296 2/1967 Japan ..... 264/290.5

47-16727 9/1972 Japan ..... 264/210.7

636275 12/1978 U.S.S.R. ..... 264/290.5

*Primary Examiner*—Hubert C. Lorin

*Attorney, Agent, or Firm*—John W. Whisler

[57] ABSTRACT

An improvement in the conventional wet-spinning process for producing acrylic fibers increases the spinning performance and/or productivity of the process and comprises imparting a plurality of stretches to the fibers as they are being dried on the heat rolls of the drying train employed in the process.

10 Claims, 1 Drawing Sheet

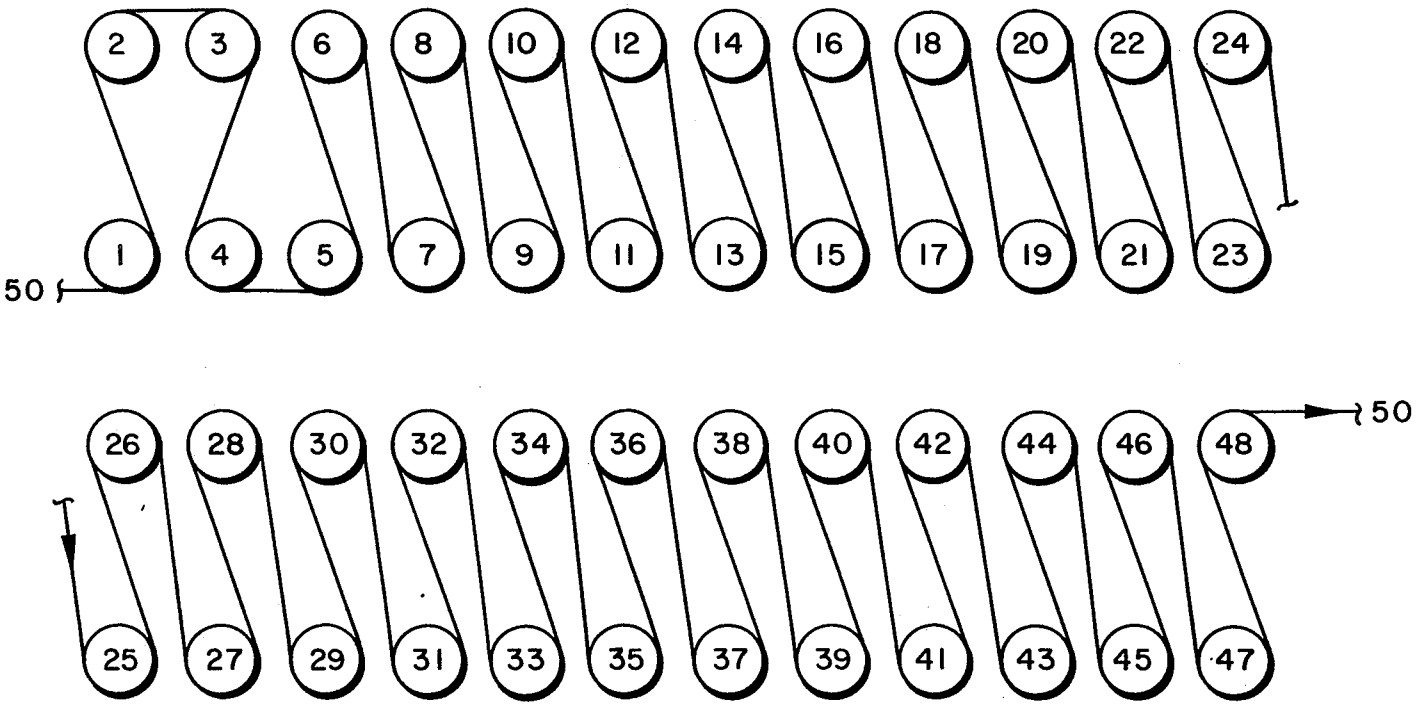
50
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
50

WET-SPINNING PROCESSES FOR PRODUCING ACRYLIC FILAMENTS

BACKGROUND OF THE INVENTION

This invention relates to an improvement in conventional wet-spinning processes for producing acrylic filaments whereby improved spinning performance (e.g. less filament breaks and wraps) and increased productivity in terms of pounds of filaments per hour are obtained. The term "acrylic", as used herein, means any long chain synthetic fiber forming polymer comprising acrylonitrile units, —$CH_2$—CH(CN)—. Acrylic polymers of particular commercial importance are those consisting of at least 85% by weight of acrylonitrile units with the balance comprising either vinylacetate, methyl methacrylate, or vinylacetate and methylvinylpyridine units.

Conventionally, wet-spinning processes for producing acrylic filaments comprise the coupled steps of extruding a solution of acrylic polymer in a suitable solvent therefor (i.e. dope) through one or more spinnerets immersed in a coagulation bath for the polymer to form filaments. Each spinneret typically has at least 20,000 (e.g. 60,000 to 100,000) orifices. The coagulation bath comprises water and solvent for the polymer. Normally, the solvent used in the coagulation bath is the same as that used in the dope. Typical solvents include organic solvents, such as dimethylacetamide (DMAc) and dimethylformamide (DMF), and inorganic solvents, such as an aqueous solution of sodium thiocyanate or nitric acid. The as-spun filaments are withdrawn from the bath, washed with water to remove solvent, wet-stretched several times their as-spun length in a hot (60° to 100° C.) water bath to impart molecular orientation to the filaments and then dried on a drying roll train. The term "drying roll train", as used herein, means a plurality of at least 20 rotatable rolls arranged serpentinely in series over which filaments are passed sequentially from roll to roll and over each roll with a partial wrap and under sufficient tension to prevent slippage of the filaments on the rolls. At least some of the rolls are heated by means of pressurized steam which is circulated internally through the roll(s). The processing conditions (including composition of the dope and coagulation bath, the amount of wet-stretch, temperatures and filament speeds) are correlated to provide useful filaments of a desired denier. Following the drying step, the filaments are further processed in a conventional manner, for example, crimped, annealed and cut to staple or collected as tow.

In the past, acrylic filaments were typically produced in the denier range of 3 to 18 denier and, accordingly, the diameter of the spinneret orifices of existing conventional wet-spinning processes are of an appropriate size to produce filaments having such deniers. However, recently, finer dpf acrylic filaments have gained importance. Unfortunately, such finer denier filaments cannot be economically and feasibly produced using the existing wet-spinning equipment. For example, attempts to provide finer deniers by increasing the wet-stretch imparted to the filaments significantly reduces the spinning performance of the process. On the other hand, replacing the existing spinnerets with spinnerets having smaller orifices is costly. Also, attempts to provide the finer denier filaments by hot-stretching the filaments, for example, on the last rolls of the drying roll train has not proven successful because the filaments cannot be heated to a sufficient temperature on the drying rolls to endure the drying roll stretch, that is, filaments break and the spinning performance of the process is reduced. (Finer dpf filaments have more surface area per pound than larger dpf filaments and require more drying). While more drying rolls could be added, doing so, even if space permitted, would add considerably to the overall cost of the process. Also, for this same reason, the productivity of existing equipment is limited because of its drying capacity, that is, if more pounds of filaments are added to the drying rolls or if the rate, in terms of pounds per hour, at which the filaments are processed is increased, the existing drying roll train simply cannot dry the filaments.

SUMMARY OF THE INVENTION

The present invention provides an improvement in conventional wet-spinning processes for producing acrylic filaments. The process differs from the above-described conventional processes, in that, at least two pair of successive rolls in the drying roll train are operated at peripheral speeds such that a stretch is imparted to the filaments between each pair. The number and amount of the drying roll stretches and wet stretch are correlated to provide filaments of a desired denier. Stretching of the filaments on the drying rolls in accordance with the improvement of the present invention increases the tension of the filaments on the drying rolls which improves the transfer of the heat from the rolls to the filaments. Better heat transfer translates to more efficient (i.e. quicker) drying of the filaments on the rolls. Consequently, the rate at which the filaments are dried is increased and/or more pounds of filaments and/or finer denier filaments may be dried (i.e. produced) per hour that can be dried if the drying roll stretches are omitted. Thus, the productivity of conventional acrylic wet-spinning equipment can be increased by practicing the improvement of the invention. Also, the improvement permits the wet-stretch to be reduced while keeping the total stretch the same and, thereby, improving the spinning performance of the process. The foregoing advantages may be accomplished using existing equipment. Surprisingly, it has been observed that if a single stretch is taken on the last rolls of the drying roll train instead of a plurality of smaller stretches distributed over the entire train, the sum of which totals the single stretch, the foregoing advantages are not realized and, in fact, often cause filament breaks, particularly, in the case of finer denier filaments.

While the improvement of the present invention is particularly suited for application with existing (in-place) acrylic wet-spinning equipment, it may be also be used with new equipment.

DESCRIPTION OF THE FIGURE

The FIGURE is a schematic illustration of a drying roll train useful in practicing the improvement of the present invention.

DETAILED DESCRIPTION OF THE INVENTION

The improvement of the present invention is accomplished by modifying the rolls of the drying roll train of the convention wet-spinning process for producing acrylic filaments so that at least two pair of successive heated rolls in the train are operated at peripheral speeds such that a stretch is imparted to the filaments between each pair of rolls. A drying roll train which may suitably be used to practice the improvement of the present invention is shown in the accompanying FIGURE, wherein drying rolls 1–48 are arranged serpentinely in series. Filaments 50 are passed over each roll with a partial wrap in the manner shown in the FIGURE. Each roll is of a conventional design, i.e., is hollow, made of stainless steel, and has a outside diameter of about 14 inches (35.6 cm), and a length of 42 inches (106.7 cm). A fluid, such as chilled water or steam, may be circulated through each of the rolls in a conventional manner for purposes of controlling the surface temperature of the rolls. Typically, Rolls 1, 2 and 3 are cold rolls (not heated or cooled), rolls 4–44 are heated rolls and rolls 45–48 are cooled rolls. A separate stretch may be imparted to filaments 50 between any pair of successive heated rolls, for example, between rolls 12 and 13 and rolls 16 and 17. Preferably, at least four stretches and, most preferably, 5 to 10 stretches (e.g. 6 or 8 stretches) are imparted to filaments 50 in the drying roll train. The stretches are imparted to filaments 50 by operating the rolls at appropriate selected peripheral speeds. For example, by operating rolls (1–12) at a given speed ($S_1$), rolls (13–16) at a higher given speed ($S_2$) and rolls (17–48) at a given speed ($S_3$) higher than ($S_2$), a stretch is imparted to filaments 50 between rolls 12 and 13 and between rolls 16 and 17. The amount of each individual stretch may be same or different from the other individual stretches.

From the drying roll train the filaments may be further processed in a conventional manner, that is, collected in tow form or crimped, annealed with steam, cut to staple length and baled.

The following examples are given to further illustrate the invention. In the examples percentages are weight percentages unless otherwise specified.

EXAMPLE

In this example, acrylic filaments were produced in accordance with the improvement of the present invention using conventional wet-spinning equipment.

A copolymer comprising 92.5% acrylonitrile and 7.5% vinylacetate was dissolved in DMAc in an amount sufficient to provide a 25% copolymer solution (dope). The dope, at a temperature of 105° C., was extruded through 24 spinnerets, each having 100,000 round orifices of a 2.5 mils (0.06 mm) diameter. Each spinneret was immersed in an aqueous DMAc coagulation bath having a DMAc concentration of 51% with water being added during spinning to maintain this concentration. The temperature of the bath was maintained at about 34° C. Each resulting filament bundle (tow) was withdrawn from the bath washed with water to remove DMAc and wet-stretched 4.62 times in 90° C. water. A finish was then applied to each tow. The tows were then passed through a drying roll train having the configuration shown in the FIGURE. Rolls 1–3 were unheated, rolls 4–44 were heated to a surface temperature of 160° C. by means of steam and rolls 45–48 were cooled to a surface temperature of 55° C. by means of chilled water. A stretch of 1.05 times was imparted to the filaments between rolls 12 and 13, 16 and 17, 20 and 21, 24 and 25, 28 and 29, 32 and 33, 36 and 37, and 40 and 41 for a total stretch on the drying train of 1.52 times. The peripheral speed of roll 48 was 54 RPM which corresponds to a filament speed of 196 fpm (60 mpm) or to a production rate of 1430 lb/hr. (649 kg/hr). The filaments were then crimped, annealed and cut to staple having a denier of 1.2. The spinning performance of the process was excellent. When the process was repeated except that a single stretch was taken on the drying roll train (1.217 stretch between rolls 40 and 41) and the wet stretch was increased to 4.92 times to provide the same total stretch as before, the spinning performance was unacceptable. Attempts to improve spinning performance by changing the wet-stretch and drying roll stretch while maintaining the same dpf (i.e. 1.2) were unsuccessful.

In a further related experiment, the above process was again repeated, except in this instance the processing speed was increased from 54 rpm to 65 rpm, thereby increasing the production rate to 1721 lbs/hr (781 kg/hr). No noticeable reduction in spinning performance was observed.

In still further related experiments, the process was again repeated, except the processing speed, spinnerets type (hole diameter and number of holes), wet-stretch and the drying roll stretches were selected to provide staple having in one instance, a denier of 1.5; in another instance, a denier of 3.0; and in yet another instance, a denier of 5.0. In each instance spinning performance was excellent.

In yet further related experiments, the process was again repeated, except less drying roll stretches were taken. In one instance, two stretches (1.23X each) were taken; in another instance four stretches (1.11X each) were taken; and in yet another instance, six stretches (1.072X each) were taken. While two stretches provides an improvement in spinning performance over a single stretch, the spinning performance was not as good as when four or more stretches were taken.

What is claimed is:

1. In a process for producing acrylic filaments wherein a solution of acrylic polymer is a suitable solvent therefor is extruded through one or more spinnerets immersed in a coagulation bath comprising water and solvent for said polymer to form filaments that are withdrawn from said bath, washed with water to remove solvent therefrom, wet-stretched in a hot water bath to impart molecular orientation thereto and then dried and collapsed on a drying roll train comprising at least 20 heated rotating rolls arranged serpentinely in series, said filaments being passed from roll to roll and over each roll with a partial wrap and under sufficient tension to prevent significant slippage of said filaments on said rolls, wherein said process imparts a total stretch and a denier to said filaments, the improvement for reducing filament breaks and wraps or increasing productivity or both comprising the steps of (a) operating at least two pair of said rolls, each pair consisting of successive heated rolls, at peripheral speeds such that a drying roll stretch is imparted to said filaments between each said pair of said rolls and (b) reducing said wet-stretch to keep said total stretch and denier the same.

2. The process of claim 1 wherein each spinneret has at least 20,000 orifices.

3. The process of claim 2 wherein sufficient spinnerets are used to provide at least 60,000 filaments.

4. The process of claim 2 wherein said solvent in said dope and said coagulation bath is dimethylacetamide or dimethylformamide.

5. The process of claim 2 wherein two stretches are taken on said rotating rolls.

6. The process of claim 2 wherein at least four stretches are taken on said rotating rolls.

7. The process of claim 2 wherein at least six stretches are taken on said rotating rolls.

8. The process of claim 2 wherein at least eight stretches are taken on said rotating rolls.

9. The process of claim 2 wherein said stretches taken on said rotating rolls are all of about the same magnitude.

10. The process of claim 2 wherein said polymer is comprised of acrylonitrile units and of vinylacetate units.

* * * * *